US005257656A

United States Patent [19]

McLeroy

[11] Patent Number: 5,257,656

[45] Date of Patent: Nov. 2, 1993

[54] WALLET AND CARD HOLDER

[76] Inventor: James H. McLeroy, 14750-1 Beach Blvd., Jacksonville Beach, Fla. 32250

[21] Appl. No.: 813,681

[22] Filed: Dec. 26, 1991

[51] Int. Cl.[5] ..... A45C 1/06

[52] U.S. Cl. ..... 150/132; 150/147

[58] Field of Search ..... 150/131, 132, 139, 140, 150/141, 146, 147, 134

[56] References Cited

U.S. PATENT DOCUMENTS

| | | | |
|---|---|---|---|
| 658,394 | 9/1900 | Peters | 150/139 X |
| 779,742 | 1/1905 | Schultze | 150/132 |
| 906,596 | 12/1908 | Wilson | 150/134 X |
| 940,853 | 11/1909 | Cardwell | 150/132 |
| 1,035,945 | 8/1912 | Cardwell | 150/132 |
| 1,228,251 | 5/1917 | Smith | 150/132 |
| 1,545,577 | 7/1925 | Arms | 150/147 |
| 1,645,709 | 10/1927 | Lorber | 150/132 X |
| 2,078,935 | 5/1937 | Downes | 150/132 |
| 2,654,409 | 10/1953 | Cox | 150/132 X |
| 3,446,520 | 5/1969 | Osher | 150/147 |
| 4,153,275 | 5/1979 | Phillips | 150/146 X |
| 4,890,728 | 1/1990 | Grimsley | 150/147 X |
| 4,945,961 | 8/1990 | Healy | 150/132 |

FOREIGN PATENT DOCUMENTS

| | | | |
|---|---|---|---|
| 578825 | 10/1924 | France | 150/131 |
| 1036997 | 9/1953 | France | 150/147 |
| 1459254 | 10/1966 | France | 150/147 |
| 133276 | 10/1919 | United Kingdom | 150/131 |
| 994593 | 6/1965 | United Kingdom | 150/132 |

*Primary Examiner*—Sue A. Weaver

*Attorney, Agent, or Firm*—Arthur G. Yeager

[57] ABSTRACT

A wallet made of a single sheet of thin material and having four adjoining portions including a central rectangular portion adjoined on opposite sides in a horizontal direction to outer wing rectangular portions and adjoined in a vertical direction to a rectangular flap portion and two outer wing portions forming a rectangular area slightly larger on all sides than a paper money bill to be carried therein.

3 Claims, 1 Drawing Sheet

WALLET AND CARD HOLDER

BACKGROUND OF THE INVENTION

Wallets carried by both men and women are employed to carry paper money, credit cards, bills, receipts, business cards, a check book, coins, etc. These wallets become too bulky to be carried conveniently, except when hidden in a large purse. It has become almost a dream to be able to carry a very thin wallet with nothing more than a few credit cards and a small amount of paper money.

It is an object of this invention to provide a very thin wallet that can carry only a few pieces of paper money and perhaps one credit card. It is another object of this invention to provide minimum size and weight for a wallet. Still other objects will become apparent in the more detailed description which follows.

BRIEF SUMMARY OF THE INVENTION

This invention relates to a wallet for paper money comprising a thin sheet having a general T-shape wherein the cross bar of the T is slightly larger than the paper money to be concealed therein and includes a central rectangular portion connected at each lateral side through a fold line to respectively one of two outer rectangular portions, and said stem of the T being a rectangular flap connected to said central portion through a fold line, said two outer portions and said flap being foldable to lie superimposed on said central portion.

In a specific embodiment of the invention the central portion includes a slit parallel to the direction of the cross bar, and a sufficient length to permit a plastic credit card to slide therethrough.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

This invention is best understood by reference to the attached drawings.

Figure 1:
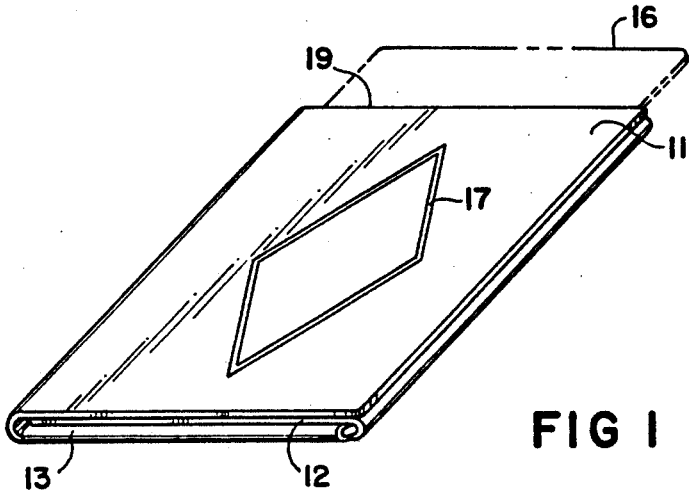
FIG. 1 is a perspective view of the wallet of this invention in the folded closed position.
Figure 2:
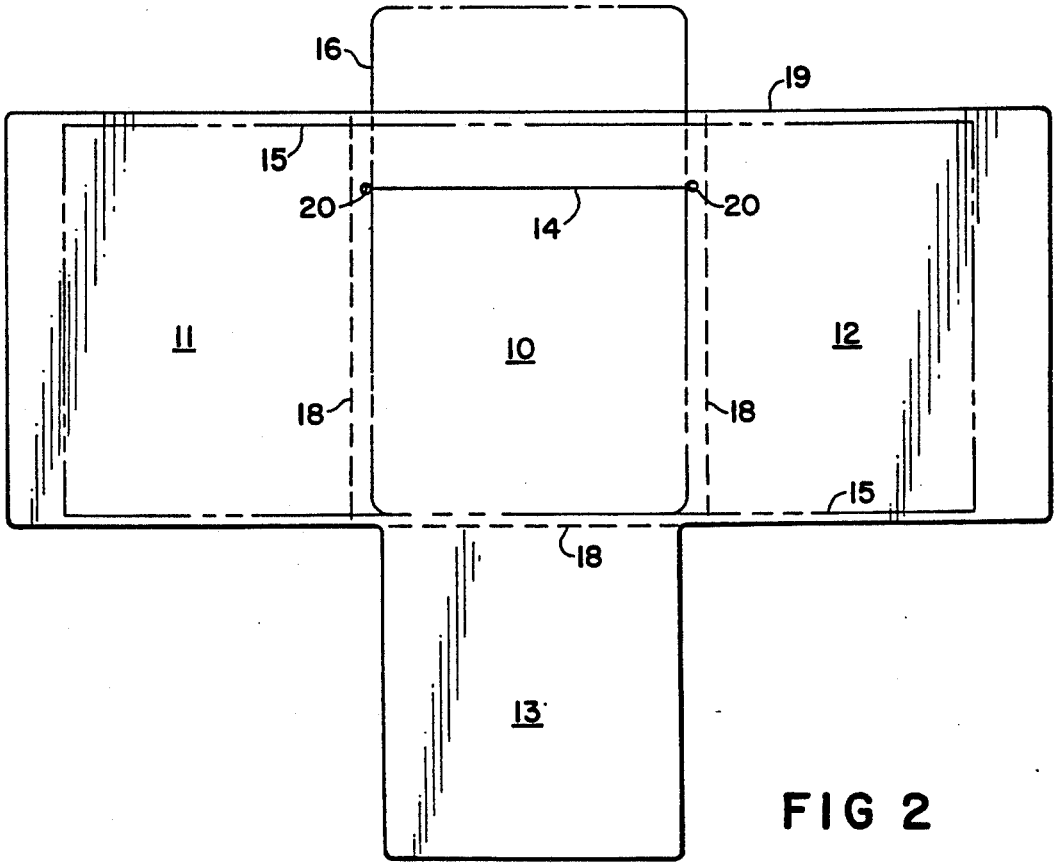
FIG. 2 is a plan view of the wallet of this invention in the unfolded open position.

The wallet is a flat, thin sheet of leather or other material that has four portions as shown in FIG. 2 that fold over each other to make a closed wallet as shown in FIG. 1. The wallet is a single integral sheet with a central portion 10, a left side portion or wing 11, a right side portion or wing 12, and a flap cover portion 13. The wallet in its open position shown in FIG. 2 has the general shape of the letter T, with portions 10, 11 and 12 forming the horizontal cross bar, and portion 13 forming the vertical stem. The three portions 11, 12 and 13 are each joined to central portion 10 by a fold line 18, which may be formed by a heated knife edge being pressed into the sheet or by thinning the sheet at the lines 18. It may be seen that paper money bills having a size as shown by dotted lines 15 fall inside the perimeter of portions 10, 11 and 12. When the paper money bills are in place, flap portion 13 is folded upwardly to overlap the money; and thereafter side wing portions 11 and 12 are folded inwardly to cover flap portion 13 in either order of succession, 11 before 12 or 12 before 11. It may be that one of side wing portions 11 or 12, is decorated with a design 17 on the outside of that side wing portion, and, if so, that portion would be folded over last in the succession just mentioned. In the arrangement of FIG. 1 it is shown that side wing portion 11 has a diamond design 17 on the outside surface. In this instance, after placing money bills in the wallet, flap portion 13 would be folded upwards first, right side wing portion 12 would be folded toward the left, and finally left side wing portion 11 would be folded toward the right to result in the arrangement of FIG. 1.

An optional additional feature is to cut slit 14 through central portion 10, preferably near the top edge 19 of the wallet. The slit 14 is preferably terminated at each end thereof by a punched hole 20 to inhibit tearing and lengthening of the slit 14. Slit 14 is long enough to receive therethrough a plastic credit card, as shown by dotted lines 16. This causes the credit card to extend above top edge 19, but it provides a convenient pocket for the credit card. When the wallet is folded as in FIG. 1.

Design 17 may or may not be included in this wallet. If included, it may be of any configuration, and applied in any way desired. For example, the design may be a metallic item cemented to the wallet or riveted or screwed to the wallet. It may be a label of paper or cloth, or leather, sewed to or glued to the wallet. It may be pressed or embossed into the wallet material. Similarly, corners of portions 11, 12, or 13 may be reinforced and beautified by metallic corner pieces to prevent the corners from curling. Materials suitable for the wallet are leather, plastic, fabric, and mixtures thereof.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A wallet for paper money comprising a thin sheet having a general T-shape wherein the cross bar of the T is slightly larger than the paper money to be concealed therein and is divided into three substantially identically sized portions including a central rectangular portion connected at each lateral side through a fold line to, respectively, one of two outer rectangular portions, and said stem of the T being a rectangular flap connected to said central portion through a fold line and being not greater in size than that of said central portion, said two outer portions and said flap being foldable to lie superimposed on said central portion, said central portion including a slit therein with its longitudinal direction generally parallel to the longitudinal direction of said cross bar.

2. The wallet of claim 1 wherein said slit is of a size to admit a plastic credit card therethrough.

3. The wallet of claim 1 having an embossed design on the side of said outer portion which is on top of said wallet in its fully folded position.

* * * * *